US006523388B1

(12) United States Patent
Winton, III

(10) Patent No.: US 6,523,388 B1
(45) Date of Patent: Feb. 25, 2003

(54) VERTICAL COMPRESSION BENDING MACHINE

(76) Inventor: George R Winton, III, 242 Ashbourne Trail, Lawrenceville, GA (US) 30043

( * ) Notice: Subject to any disclaimer, the term of this patent is extended or adjusted under 35 U.S.C. 154(b) by 0 days.

(21) Appl. No.: 09/656,335

(22) Filed: Sep. 6, 2000

(51) Int. Cl.[7] ..... B21D 7/06
(52) U.S. Cl. ..... 72/389.1; 72/389.8
(58) Field of Search ..... 72/389.1, 389.5, 72/389.8, 380, 212, 213

(56) References Cited

U.S. PATENT DOCUMENTS 3,279,236 A * 10/1966 Lance ..... 72/389.8
3,306,093 A * 2/1967 Sassak ..... 72/389.8
3,429,157 A * 2/1969 Huth ..... 72/389.8
3,756,058 A * 9/1973 Hamkins ..... 72/389.8
4,040,679 A * 8/1977 Teramachi ..... 308/6 C
4,253,709 A * 3/1981 Teramachi ..... 308/6 C
4,833,907 A * 5/1989 Grimaldo ..... 72/389.8
4,967,585 A * 11/1990 Grimaldo ..... 72/389.8

* cited by examiner

*Primary Examiner*—David Jones
(74) *Attorney, Agent, or Firm*—Staas & Halsey LLP

(57) ABSTRACT

A vertical compression bending machine that uses linear bearings to guide the ram and cushions assemblies. The inventive machine also employs an adjustment mechanism to align the wing dies relative to one another.

19 Claims, 5 Drawing Sheets

VERTICAL COMPRESSION BENDING MACHINE

BACKGROUND

1. Field of Invention

The present invention relates to a machine that bends tubing. The machine employs linear ball bearings to reduce friction in the system.

2. Description of Art

Manufacturers of industrial equipment have been building tube bending machines to bend tubing for decades. One such machine is a vertical compression bending machine. A vertical compression bender makes use of a ram die and two wing dies. During the bending process, the ram die, along with a supporting ram assembly, advances in a linear fashion toward the two wing dies. A tube, supported by the two wing dies, is initially contacted by the ram die during the advancement of the ram assembly. After the ram die makes initial contact with the tube, it continues to push through the tube while forcing the wing dies to rotate away and outward from the ram die. The ram die sees resistance from the tube along with the resistance from the wing dies. In order for the tube to stay up and inside the ram die during the bending process, the wing dies must provide a counter force (cushion) in a direction against the advancing ram die. The counter force from the wing dies will hold the tube in a firm position against the ram die. The ram die continues to advance while at the same time overcoming the resistance of the tube and wing dies. The ram die continues to advance until the tube reaches the required bend angle. At that point, the ram assembly reverses direction and returns to its home position. The wing dies also reverse direction and both wing dies rotate back to their home position.

Over the years manufacturers have relied on various types of wear pads to guide the ram assembly during the bending process. A typical wear pad is constructed from bronze and acts as a bearing surface guiding the ram die and thus the ram assembly during a bending stroke. Wear pads were designed into this application decades ago because they afforded the best load bearing capability at a reasonable cost.

A compression bender is depicted in U.S. Pat. No. 2,997,141 issued to Bower et al. The Bower et al. patent shows a bender that uses guide members 25 and 26 along with wing slides 29 and 30 to ensure that the ram die 36 is guided along a linear path during a bending operation. The guide members 25 and 26 act as wear plates. These wear plates, most often constructed from a bronze material, are the bearing surfaces that allow the ram die to lynamically thrust to and from the wing dies while at the same time providing a bearing surface guide the ram assembly along a linear path.

The Bower et al. patent also uses the same approach when guiding the motion of the piston rods 87 and 96. Bower et al. relies on the bushings inside the cushion cylinders 77 and 78 to help support the forces on the piston rods 87 and 96. Cylinders 77 and 78 provide a counter force (cushion) to the advancing ram die 36. This counter force is transmitted to the ram die 36 through the wing dies 59 and 66 and the tube.

One disadvantage of the Bower et al. patent is the friction associated with the wear plates that guide the ram assembly. These bearing surfaces often require constant maintenance and eventually will need to be replaced due to the friction associated with the wear plates.

Another disadvantage of the Bower et al. patent is the side loads on the piston rods 87 and 96. These side loads will in time require unnecessary maintenance and thus the bushings in the cylinders 77 and 78 will have to be replaced. In general, these bushings should never take side loading.

SUMMARY OF THE INVENTION

Accordingly, several objects and advantages of my invention are:

(a) to reduce the friction associated with the ram assembly during a bending operation;

(b) to reduce the cost of maintenance associated the ram and cushion assemblies;

(c) to reduce the friction of the bearing assembly used to guide the cushion assembly; and (d) to prevent a side load from imparting on the cushion cylinder's piston rod.

Still further objects and advantages will become apparent from a consideration of the ensuing description and drawings.

The foregoing objects and advantages can be achieved by providing a vertical compression bending machine comprising a first wind die which supports a second part of the tube, a frame supporting a first linear rail, a first linear bearing which slidably moves along the first linear rail, a ram block mounted to the first linear bearing, and a ram die, mounted to the ram block, which vertically moves to form a bend in the tube, wherein the ram block and first linear bearing move in conjunction with the ram die so that the first linear bearing slides along the first linear rail, and the first and second wing dies provide movable support to the tube as the ram die bends the tube.

DESCRIPTION OF THE PREFERRED EMBODIMENTS

Figure 1:
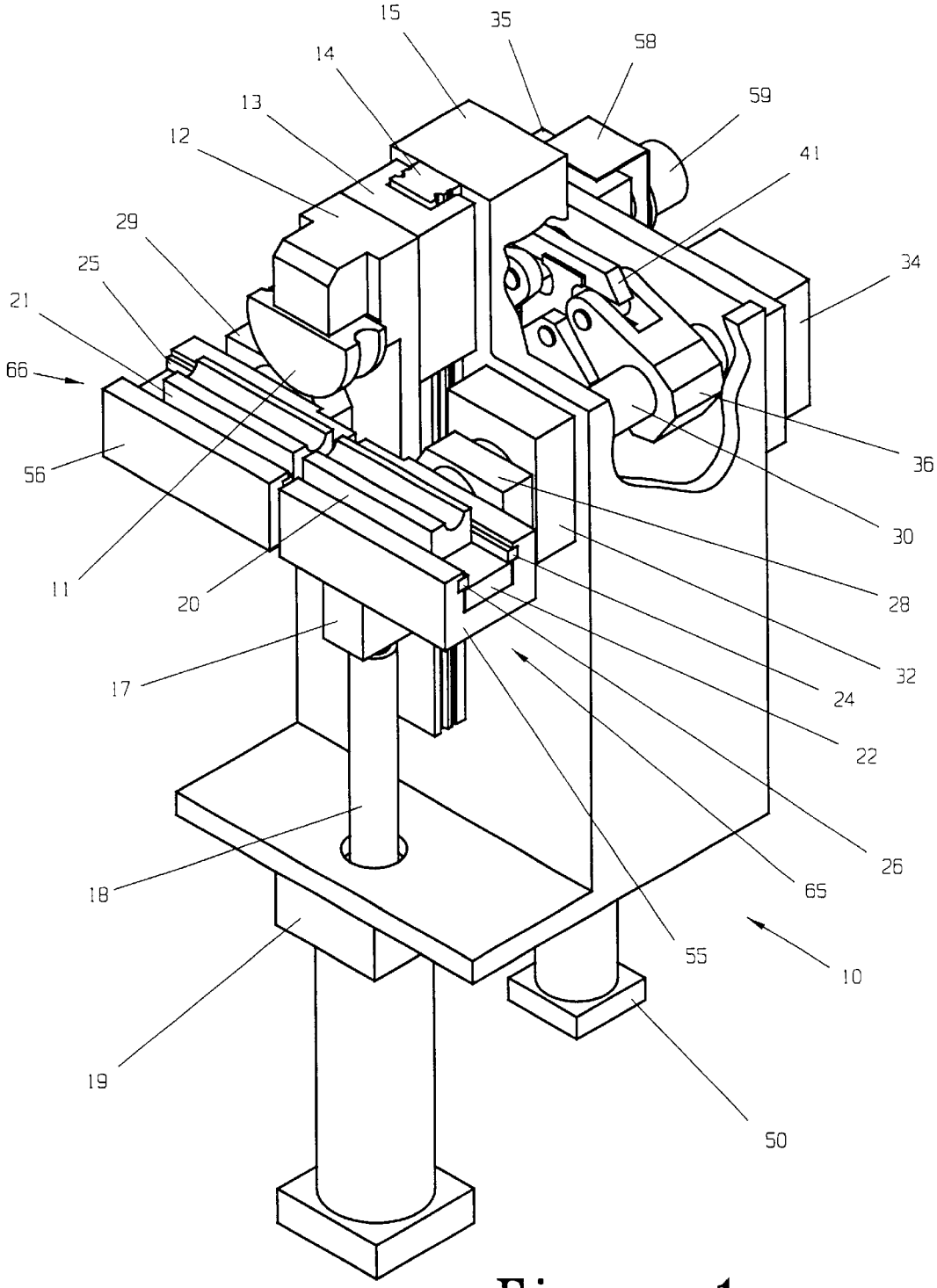
FIG. 1 shows an isometric view of the first embodiment depicting the linear rail and linear bearing supporting the ram assembly.

With initial reference to FIG. 1, the first embodiment 10 is shown. A ram die 11 is mechanically fastened to a ram block 12. Ram block 12 is mechanically fastened to a linear bearing 13. Linear bearing 13 may be of the type described by Teramachi in U.S. Pat. No. 4,040,679 and by Teramachi in U.S. Pat. No. 4,252,709.

In both U.S. Pat. No. 4,040,679 and U.S. Pat. No. 4,252,709, Teramachi teaches about a linear bearing that employs recirculating ball bearings. The ball bearings recirculate in a track while the bearing block advances in a linear fashion along a linear rail. The grooves in the linear rail help captivate the ball bearings as the ball bearings recirculate within the bearing block. This technique results in rolling friction as the linear bearing moves relative to the linear rail.

Figure 4:
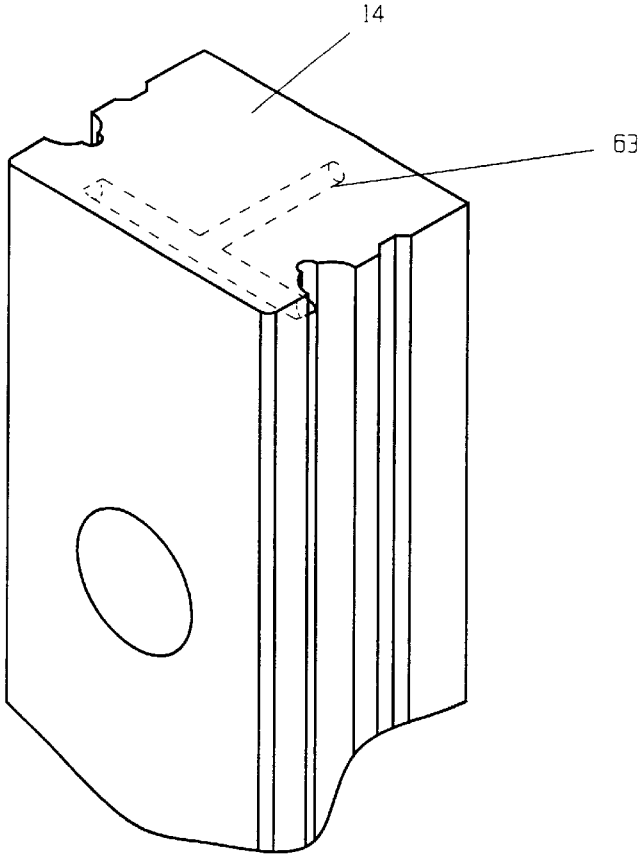
FIG. 4 shows an isometric view of the first linear rail and its internal lubrication passage.

Linear bearing 13 is coupled to a linear rail 14. A lube passage 63 is formed into linear rail 14, see FIG. 4.

Linear rail 14 is fastened to frame 15. Ram block 12 is fastened to a coupling 17. Coupling 17 is fastened to a piston rod 18 and piston rod 18 is joined to a ram cylinder 19. Ram cylinder 19 is fastened to frame 15.

A wing die 20 is supported by a wear strip 22, a wear strip 24, and a wear strip 26. Wear strips 22, 24, and 26 are supported by a support housing 55. Support housing 55 is fastened to a support block 28. Support block 28 is fastened to a cushion shaft 30. Wear strips 22, 24, and 26, support housing 55, and cushion shaft 30 are considered the first cushion shaft assembly 65.

Figure 3:
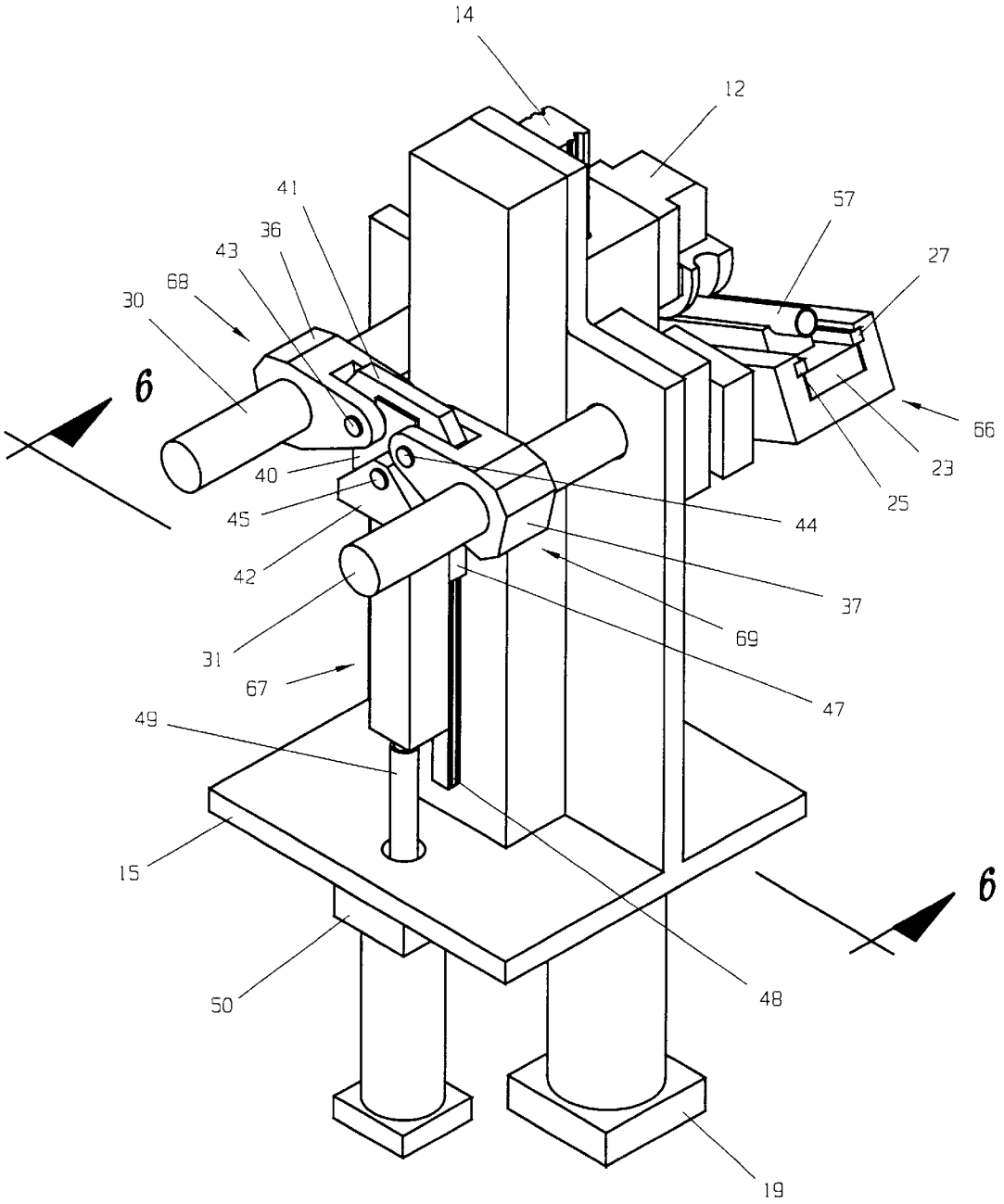
FIG. 3 shows an isometric view of the wing die assemblies, the cushion assembly, a linear rail supporting the cushion assembly, and a mechanism to adjust the wing dies relative to one another.

A wing die 21 is supported by a wear strip 23, a wear strip 25, and a wear strip 27, see also FIG. 3. Wear strips 23, 25, and 27 are supported by a support housing 56. Support housing 56 is fastened to a support block 29. Support block 29 is fastened to a cushion shaft 31, see also FIG. 3. Wear strips 23, 25, and 27, support housing 56, and cushion shaft 31 are considered the second cushion shaft assembly 66.

Cushion shaft 30 is supported by a bearing block 32 and a bearing block 34. Bearing blocks 32 and 34 are fastened to frame 15.

Figure 2:
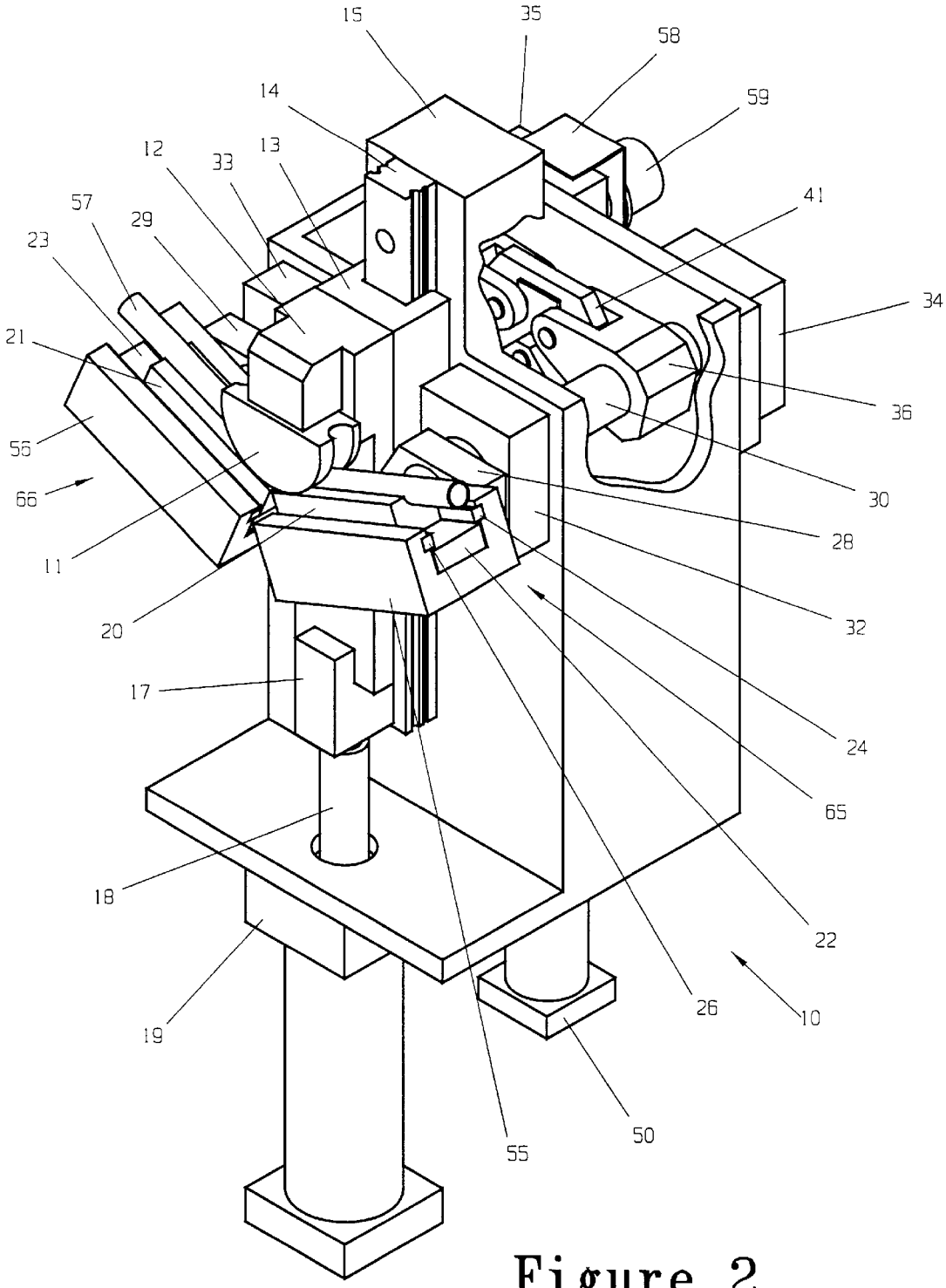
FIG. 2 shows an isometric view of the first embodiment depicting a tube being bent.

Cushion shaft 31 is supported by a bearing block 33 and a bearing block 35, see also FIG. 2. Bearing blocks 33 and 35 are fastened to frame 15.

From FIG. 2, located in wing dies 20 and 21 is a tube 57.

From FIG. 1, an encoder bracket 58 is fastened to bearing block 35. Fastened to encoder bracket 58 is an encoder 59. Encoder 59 is coupled to cushion shaft 31.

Figure 6:
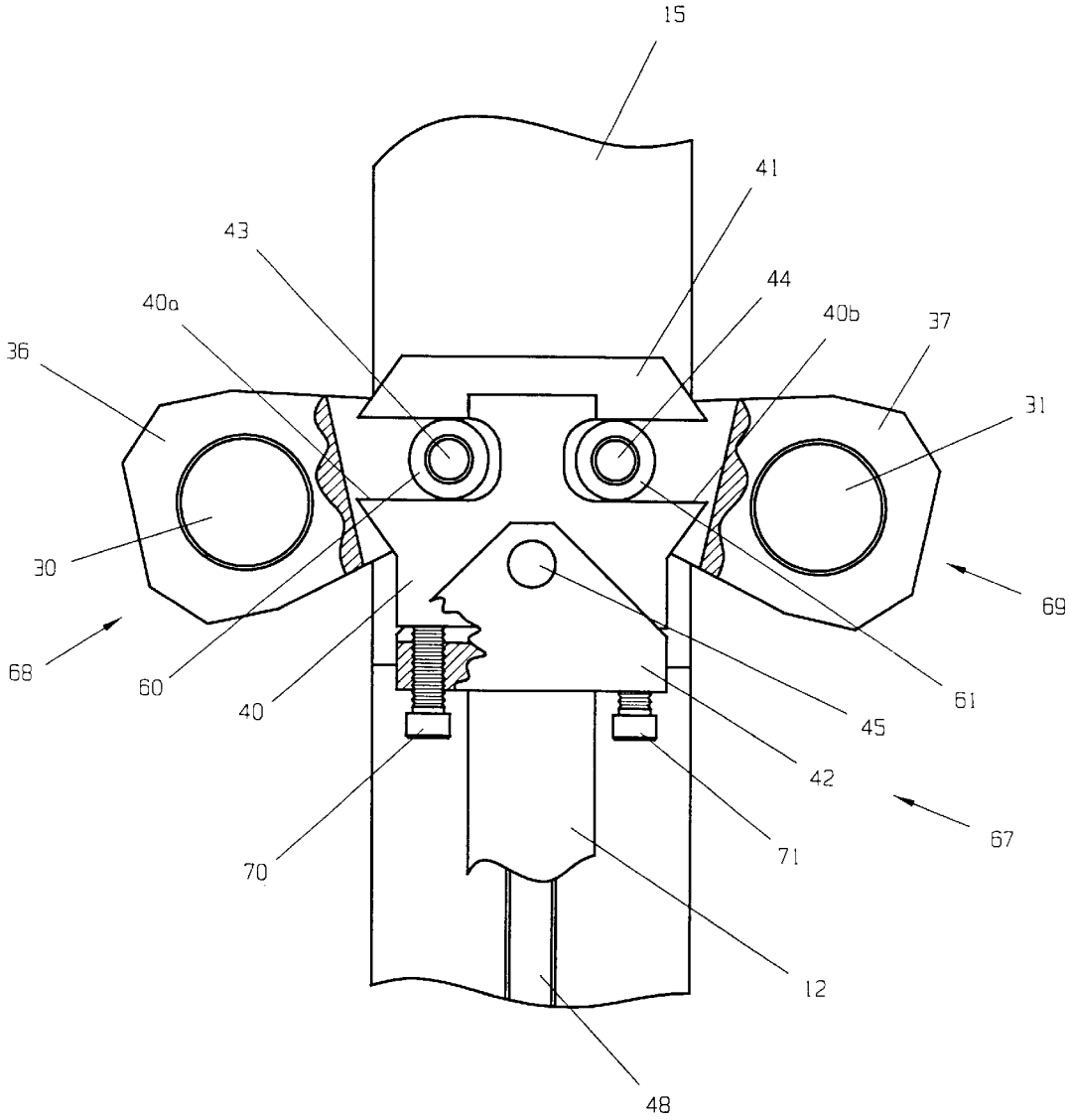
FIG. 6 shows the mechanism to adjust the position of the wing dies.

From FIGS. 3 and 6, a rocker arm 36 and a rocker arm 37 are fastened to cushion shafts 30 and 31 respectively. A rocker bearing 60 is supported by a pin 43. Pin 43 is fastened to rocker arm 36. A rocker bearing 61 is supported by a pin 44. Pin 44 is fastened to rocker arm 37.

Rocker arm 36, rocker bearing 38, and pin 43 are considered the rocker arm assembly 68. Rocker arm 37, rocker bearing 39, and pin 44 are considered the rocker arm assembly 69.

From FIG. 6, rocker bearings 60 and 61 roll inside a tilt block 40 on surface 40*a* and 40*b*, respectively. A cap block 41, fastened to tilt block 40, captivates rocker bearings 60 and 61 against tilt block 40, see FIG. 6. A pin 45 supports tilt block 40. Pin 45 is fastened to housing 42. A bolt 70 and a bolt 71 are threaded into housing 42 and both bolts 70 and 71 butt up against tilt block 40. Housing 42 is fastened to a piston rod 49. Piston rod 49 is connected to a cushion cylinder 50. Cushion cylinder 50 is fastened to frame 15. Housing 42 is fastened to a linear bearing 47. Linear bearing 47 is coupled to a linear rail 48. Linear rail 48 is fastened to frame 15.

Linear bearing 47 may be of the type described by Teramachi in U.S. Pat. No. 4,040,679 and by Teramachi in U.S. Pat. No. 4,252,709.

In both U.S. Pat. No. 4,040,679 and U.S. Pat. No. 4,252,709, Teramachi teaches about a linear bearing that employs recirculating ball bearings. The ball bearings recirculate in a track while the bearing block advances in a linear fashion along a linear rail. The grooves in the linear rail help captivate the ball bearings as the ball bearings recirculate within the bearing block. This technique results in rolling friction as the linear bearing moves relative to the linear rail.

Figure 5:
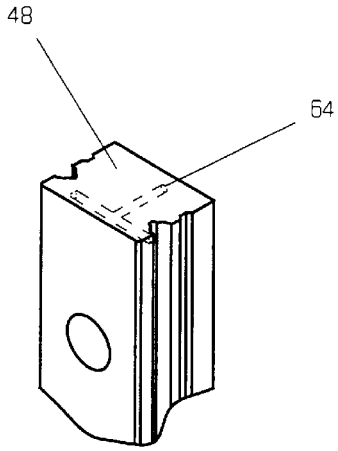
FIG. 5 shows an isometric view of the second linear rail and its internal lubrication passage.

Linear bearing 47 is coupled to linear rail 48. Linear rail 48 is of the type described by Teramachi in U.S. Pat. Nos. 4,040,679 and 4,253,709. A lube passage 64 (see FIG. 5) is formed into linear rail 48.

Tilt block 40, cap block 41, pin 45, bolt 70, bolt 71, and housing 42 make up the cushion assembly 67.

In operation, pressure is applied to one side of cylinder 19 causing piston rod 18, initially extended in its home position, to retract toward cylinder 19. The retraction of piston rod 18 causes coupling 17, ram block 12, ram die 11, and linear bearing 13 to advance toward cylinder 19.

Prior to ram die 11 making initial contact with tube 57, sufficient pressure is present in cushion cylinder 50 to cause piston rod 49 to be fully extended in the home position. At this point, wing dies 20 and 21 are adjacent to one another at a right angle as shown in FIG. 1.

From FIG. 2, the ram die 11 continues to advance toward ram cylinder 19 and thus starts to bend tube 57. As the bending process continues, a pressure is maintained in cushion cylinder 50. This pressure creates a counter force (cushion) against the advancing ram die 11.

The counter force is realized by ram die 11 when wing dies 20 and 21 are forced to rotate about cushion shafts assemblies 65 and 66. The pressure in cushion cylinder 50 tends to prevent cushion shaft assemblies 65 and 66 from rotating. With a pressure in cushion cylinder 50, piston rod 49 tends to force cushion assembly 67 away from cushion cylinder 50. This causes rocker arm assemblies 68 and 69 to keep a counter torque on cushion shaft assemblies 65 and 66. This counter torque is in opposition to the advancing ram die 11. As ram die 11 advances, it not only bends tube 57, but it also forces piston rod 49 to retract into cushion cylinder 50. Linear bearing 47 and linear rail 48 support cushion assembly 67 and piston rod 49 as piston rod 49 travels in a direction parallel to linear rail 48. Any side loading caused by rocker arm assemblies 68 and 69 on cushion assembly 67 will be carried by linear bearing 47 and linear rail 48.

When encoder 59 realizes the preset bend angle, the pressure in ram cylinder 19 causes ram die 11 to return to its home position. This in turn causes cushion cylinder 50 to extend piston rod 49 and thus returns both wing dies 20 and 21 to their home position.

During the initial setup of the machine, it may be necessary to adjust the relative position of wing die 20 with respect to wing die 21. When in the correct home position, both wing dies 20 and 21 should be adjacent and at a right angle to one another in the home position. Therefore, both die 20 and die 21 should be inline to one another when cylinder 19 is in the extended position. Wing dies 20 and 21 can be adjusted to ensure that both wing dies 20 and 21 are inline to one another (coplanar). By adjusting bolts 70 and 71, the angle between housing 42 and tilt plate 40 will change. Adjusting bolts 70 and 71 will rotate tilt plate 40 about pin 45. By advancing bolt 70 and retracting bolt 71, wing die 20 will rotate up and away from ram cylinder 19. At the same time, wing die 21 will rotate down and toward ram cylinder 19. By retracting bolt 70 and advancing bolt 71 toward tilt plate 40, wing die 20 will rotate down and toward cylinder 19 and wing die 21 will rotate up and away from cylinder 19. This adjustment feature provides for ease of assembly to ensure that both wing dies are inline (parallel and coplanar) to one another in the home position. When wing die 20 and wing die 21 are inline, the relative angle formed between both dies 20 and 21 is zero. The relative angle is measured in the plane at which tube 57 is being bent.

During operation of the inventive machine, lubrication can be supplied to the rolling elements located inside linear bearings 13 and 47 through lube passage 63 and 64, respectively. As lubrication is supplied to lube passages 63 and 64, the rolling elements inside linear bearings 13 and 47 respectively will come in contact with the lubricant being transported through lube passages 63 and 64.

Linear bearings 13 and 47 make use of ball bearings as a rolling element. It should be noted that the ball bearings could be replaced with roller bearings or needle bearings. Both the roller bearings and needle bearings would take the form of a right circular cylinder. This approach would improve the load bearing capability of the linear bearing.

Cylinders 19 and 50 operate on hydraulic pressure. However, any number of mechanical power devices could replace one or both of cylinders 19 and 50. For example, an all electric actuator could replace either cylinder 19 and/or cylinder 50.

Accordingly, the scope of the invention should be determined not by the embodiments illustrated, but by the appended claims and their legal equivalents.

What is claimed is:

1. A compression bending machine to bend a tube, comprising:

a first wing die which supports a first part of the tube;

a second wing die which supports a second part of the tube;

a frame;

a first linear rail supported by the frame;

a first linear bearing which slidably moves along the first linear rail;

a ram block mounted to the first linear bearing; and a ram die, mounted to the ram block, which moves to form a bend in the tube, wherein the ram block and first linear bearing move in conjunction with the ram die so that the first linear bearing slides along the first linear rail, and the first and second wing dies provide movable support to the tube as the ram die bends the tube;

wherein the first linear bearing comprises ball bearings which roll along the first linear rail as the first linear bearing moves along the first linear rail.

2. The compression bending machine according to claim 1, wherein the first linear rail comprises a lube passage formed therein, the lube passage having lubricant to lubricate the first linear bearing.

3. The compression bending machine according to claim 1, further comprising:

a coupling fastened to the ram block;

a first driving device, attached to the coupling, which moves the coupling, ram block, ram die and first linear bearing, enabling the ram die to form the bend in the tube.

4. The compression bending machine according to claim 3, further comprising:

a first cushion shaft assembly which supports the first wing die;

a second cushion shaft assembly which supports the second wing die;

a first rocker arm assembly fastened to the first cushion shaft assembly;

a second rocker arm assembly fastened to the second cushion shaft assembly;

a cushion assembly coupled to the first and second rocker arm assemblies; and a second driving device, attached to the cushion assembly, which movably supports the first and second wing dies from an initial position to a completed bend position as the ram die bends the tube, and moves the first and second wing dies back from the completed bend position to the initial position subsequent to completion of the bend.

5. The compression bending machine according to claim 4, further comprising:

a second linear rail mounted on the frame; and a second linear bearing, mounted to the cushion assembly, which slidably moves along the second linear rail as the second driving device moves the cushion assembly so as to guide the cushion assembly.

6. The compression bending machine according to claim 3, wherein the first driving device comprises:

a piston rod coupled to the coupling; and a ram cylinder which receives the piston rod.

7. The compression bending machine according to claim 4, wherein: the first driving device comprises:

a first piston rod coupled to the coupling, and a ram cylinder which receives the first piston rod; and the second driving device comprises:

a second piston rod coupled to the cushion assembly, and a cushion cylinder which receives the second piston rod.

8. The compression bending machine according to claim 5, wherein the second linear bearing comprises ball bearings which roll along the second linear rail as the second linear bearing moves along the second linear rail.

9. The compression bending machine according to claim 5, wherein the second linear bearing comprises roller bearings which roll along the second linear rail as the second linear bearing moves along the second linear rail.

10. The compression bending machine according to claim 5, wherein the second linear rail comprises a lube passage formed therein, the lube passage having lubricant to lubricate the second linear bearing.

11. The compression bending machine according to claim 1, further comprising:

a tilt plate which causes the first and second wing dies to rotate;

first and second bolts which adjust the tilt plate so as to rotate the first and second wing dies.

12. The compression bending machine according to claim 4, further comprising:

a tilt plate which causes the first and second wing dies to rotate;

wherein the cushion assembly comprises first and second bolts which adjust the tilt plate so as to rotate the first and second wing dies about the first and second cushion shaft assemblies, respectively.

13. A compression bending machine to bend a tube, comprising:

a first wing die which supports a first part of the tube;

a second wing die which supports a second part of the tube;

a frame;

a first linear rail supported by the frame;

a first linear bearing which slidably moves along the first linear rail;

a ram block mounted to the first linear bearing; and a ram die, mounted to the ram block, which moves to form a bend in the tube, wherein the ram block and first linear bearing move in conjunction with the ram die so that the first linear bearing slides along the first linear rail, and the first and second wing dies provide movable support to the tube as the ram die bends the tube;

wherein the first linear bearing comprises roller bearings which roll along the first linear rail as the first linear bearing moves along the first linear rail.

14. A compression bending machine to bend a tube, comprising:

a first wing die which supports a first part of the tube;

a second wing die which supports a second part of the tube;

a ram block; and a ram die, mounted to the ram block, which moves to form a bend in the tube, wherein the first and second wing dies provide movable support to the tube as the ram die bends the tube;

a tilt plate which causes the first and second wing dies to rotate;

at least one bolt which adjusts the tilt plate so as to rotate the first and second wing dies.

15. The compression bending machine according to claim 14, wherein the at least one bolt comprises first and second bolts which adjust the tilt plate so as to rotate the first and second wing dies.

16. A compression bending machine to bend a tube, comprising:

a first wing die which supports a first part of the tube;

a second wing die which supports a second part of the tube;

a frame;

a ram block;

a ram die, mounted to the ram block, which moves to form a bend in the tube, wherein the first and second wing dies provide movable support to the tube as the ram die bends the tube;

a first cushion shaft assembly which supports the first wing die;

a second cushion shaft assembly which supports the second wing die;

a first rocker arm assembly fastened to the first cushion shaft assembly;

a second rocker arm assembly fastened to the second cushion shaft assembly;

a cushion assembly coupled to the first and second rocker arm assemblies; and a driving device, attached to the cushion assembly, which movably supports the first and second wing dies from an initial position to a completed bend position as the ram die bends the tube, and moves the first and second wing dies back from the completed bend position to the initial position subsequent to completion of the bend;

a linear rail mounted on the frame; and a linear bearing, mounted to the cushion assembly, which slidably moves along the linear rail as the driving device moves the cushion assembly so as to guide the cushion assembly.

17. The compression bending machine according to claim 16, wherein the linear bearing comprises ball bearings which roll along the linear rail as the linear bearing moves along the linear rail.

18. The compression bending machine according to claim 16, wherein the linear rail comprises a lube passage formed therein, the lube passage having lubricant to lubricate the linear bearing.

19. The compression bending machine according to claim 16, further comprising:

a tilt plate which causes the first and second wing dies to rotate;

wherein the cushion assembly comprises first and second bolts which adjust the tilt plate so as to rotate the first and second wing dies about the first and second cushion shaft assemblies, respectively.

* * * * *